US008878640B2

(12) United States Patent
Suzuki et al.

(10) Patent No.: US 8,878,640 B2
(45) Date of Patent: Nov. 4, 2014

(54) COMMON-MODE CHOKE COIL

(71) Applicant: FDK Corporation, Tokyo (JP)

(72) Inventors: Kenichirou Suzuki, Tokyo (JP); Kiyoshi Hironaka, Tokyo (JP); Yutaka Ikeda, Tokyo (JP)

(73) Assignee: FDK Corporation, Tokyo (JP)

( * ) Notice: Subject to any disclaimer, the term of this patent is extended or adjusted under 35 U.S.C. 154(b) by 0 days.

(21) Appl. No.: 14/189,191

(22) Filed: Feb. 25, 2014

(65) Prior Publication Data

US 2014/0253273 A1 Sep. 11, 2014

(30) Foreign Application Priority Data

Mar. 6, 2013 (JP) ..... 2013-044305

(51) Int. Cl.
*H01F 27/02* (2006.01)

(52) U.S. Cl.
USPC ..... 336/90

(58) Field of Classification Search
USPC ..... 336/65, 90, 196, 198, 200, 232
See application file for complete search history.

(56) References Cited

U.S. PATENT DOCUMENTS 6,456,182 B1 * 9/2002 Katayama et al. ..... 336/181
6,480,088 B2 * 11/2002 Okamoto ..... 336/229
6,917,273 B2 * 7/2005 Okamoto ..... 336/200

FOREIGN PATENT DOCUMENTS

JP 2008-244247 10/2008

* cited by examiner

*Primary Examiner* — Tuyen Nguyen
(74) *Attorney, Agent, or Firm* — Wenderoth, Lind & Ponack, L.L.P.

(57) ABSTRACT

A common mode choke coil includes a quadrilateral core 4; first and second core covers 2, 3 disposed opposite to each other on the upper and lower surfaces of the core 4 so as to cover the outer periphery of the core 4; and rectangular copper wires 8 wound on the opposite side portions of the core 4 of the first and second core covers 2, 3. The second core cover 3 is disposed on a component-mounting face. The first and second core covers 2, 3 include a pair of linear portions surrounding the corresponding opposite sides of the core 4 which linear portions constitute winding portions 5. The lower surface of the second core cover 3 has a pedestal portion 6 which protrudes more toward the component-mounting face than the winding portions 5, and extends out along the component-mounting face in a direction perpendicular to axis lines of the winding portions 5. The lower face at the tip of the protruding part of the pedestal portion 6 has seat faces **6*a* on which parts of the rectangular copper wires 8 drawn from the winding portions 5 toward the component-mounting face are provided as mounting terminals 12. Tip portions of the rectangular copper wires 8 are bent upward from the seat faces 6*a*** at the edge of the tip of the protruding part of the pedestal portion.

3 Claims, 7 Drawing Sheets

COMMON-MODE CHOKE COIL

BACKGROUND OF THE INVENTION

1. Field of the Invention

The present invention relates to a common-mode choke coil adapted for high current applications and surface-mounting.

2. Description of the Related Art

Generally, in an electrical transmission cable utilizing a differential transmission system and the like, a common mode choke coil is interposed between two signal lines for eliminating common mode noise current caused by a difference between them in transmission characteristics such as a difference in impedance. Such a common-mode choke coil is provided with two sets of choke coils whose windings are wound on a core (magnetic body) in the same direction.

FIGS. 9A and 9B show a conventional common-mode choke coil which includes a core assembly 100 having a ring-shaped core made of magnetic material, with the outer periphery of the core assembly covered with a core cover made of synthetic resin constituting an insulating layer, a first coil 20 of round copper wire wound on a part of the outer periphery of the core assembly, and a second coil 30 of round copper wire wound on another part of the outer periphery of the core assembly in the same direction as the first coil 20.

When such a common-mode choke coil is used for surface-mounting, the coil is required to have a base plate 40 provided with terminals 50 to which the first and second coils 20 and 30 are connected at their respective ends 20*a*, 30*a*.

This has caused a problem that welding the ends 20*a*, 30*a* of the first and second coils to the respective terminals 50 and like operations require a considerable workload, thereby leading to increased manufacturing cost.

Also, such a conventional coil has a problem that, as the core assembly 100, on which the first and second coils 20, 30 are wound, is mounted on a circuit board in such a manner that it stands thereon, a design for reduction in height of the circuit board is rendered wasted.

Japanese Patent Laid-Open. No. 2008-244247 discloses a common-mode choke coil of this kind which the Applicant of the present application previously proposed.

SUMMARY OF THE INVENTION

The present invention is made in view of the above described situations, and has an object to provide a common-mode choke coil capable of being easily adapted for high current applications and surface-mounting on a circuit board, and capable of achieving a reduction in height.

In order to achieve the above object, a first aspect of the invention, as forth in Claim 1, provides a common-mode choke coil which includes:

a quadrilateral core, first and second core covers disposed opposite to each other on the upper and lower surfaces of the core so as to cover the outer periphery of the core; and rectangular copper wires extending from the outer peripheries of the first and second core covers and wound on the opposite side portions of the core;

wherein the second core cover is disposed on a component-mounting face of a circuit board;

wherein the first and second core covers include a pair of linear portions surrounding the corresponding opposite sides of the core which linear portions constitute winding portions of the rectangular copper wires, and the lower surface of the second core cover is provided with a pedestal portion that is integrally formed therewith, wherein the pedestal portion protrudes more toward the component-mounting face than the winding portions, and extends out along the component-mounting face in a direction perpendicular to axis lines of the winding portions, and wherein the lower face at the tip of the protruding part of the pedestal portion is provided with seat faces on which parts of the rectangular copper wires drawn from the winding portions toward the component-mounting face are provided as mounting terminals, and tip portions of the rectangular copper wires are bent upward from the seat faces at the edge of the tip of the protruding part of the pedestal portion.

According to a second aspect of the invention, as claimed in Claim 2, the above-described seat faces form recesses at which both ends of the rectangular copper wires are positioned, respectively.

According to a third aspect of the invention, as claimed in Claim 3, the common mode choke coil further includes a top panel having a flat portion, the top panel being removably mounted on the top portion of the first core cover.

According to the first to third aspects of the invention, the pedestal portion protrudes more toward the component-mounting face than the winding portions of the first and second core covers surrounding the opposite sides of the core, and extends out in the direction perpendicular to axis lines of the winding portions, and the lower face of at the tip of the protruding part of the pedestal portion is provided with the seat faces on which the rectangular copper wires drawn from the winding portions are provided as mounting terminals. Thus, the height uniformity among a plurality of mounting terminals is improved, thereby allowing the mounting terminals to be easily located on the same plane and ensuring that the mounting terminals are disposed at the respective mounting position on the component-mounting face. This increases the reliability of surface mounting and improves the quality thereof.

Moreover, the lower surface of the second core cover is provided with the pedestal portion on which the seat faces are formed that is integrally formed therewith, by which a reduction in height can be achieved. The feature can also reduce the number of components and assembling process steps, which thereby can reduce manufacturing costs and contribute to the reduction in size of the product.

According to the second aspect of the invention, the seat faces form recesses at which one and the other ends of the rectangular copper wires are positioned, respectively. Thus, when the rectangular copper wires are manually bent in the manufacturing process, the rectangular copper wires can be bent at the edge of the seat faces without displacements of the wires, resulting in increased work efficiency in the assembling process.

According to the fourth aspect of the invention, the top panel having the flat portion is removably mounted on the top portion of the first core cover. Thus, while providing protection for the rectangular copper wires wound in the winding portions and the like, the flat portion of the top panel allows the common-mode choke coil to be securely vacuum-sucked and held, thereby enabling efficient handling and transfer of the common-mode choke coil 1.

DETAILED DESCRIPTION OF THE PREFERRED EMBODIMENTS

Figure 1:
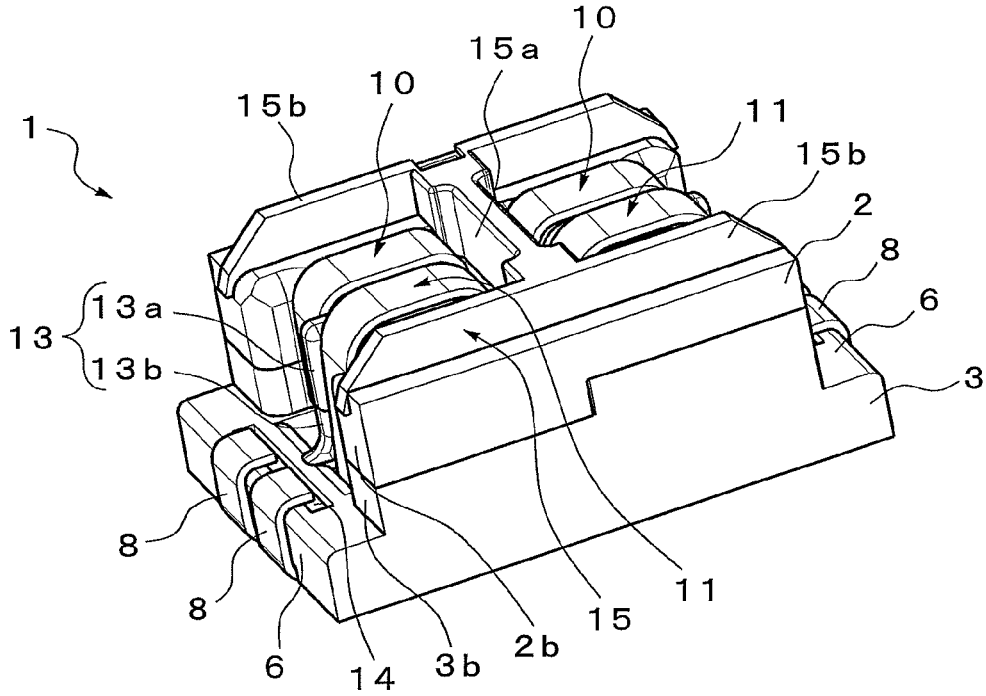
FIG. 1 is a perspective view of a common-mode choke coil in accordance with one embodiment of the present invention.

FIGS. 1 to 8 show a common-mode choke coil in accordance with one embodiment of the present invention, which is generally configured to include a quadrilateral core 4, first and second core covers 2, 3 disposed opposite to each other on the upper and lower surfaces of the core 4 so as to cover the outer periphery of the core 4, and rectangular copper wires 8 extending from the outer peripheries of the first and second core covers 2, 3 and wound on the opposite side portions of the core 4, such that the second core cover 3 is disposed on a component-mounting face of a circuit board (not shown).

The quadrilateral core 4 is made from a magnetic body such as ferrite and formed to have a rectangular shape in plan view. As shown in FIG. 6, the first core cover 2 is made of an insulating material such as synthetic resin and formed to have a substantially quadrilateral shape in plan view. The first core cover 2 includes a recess 2*a* formed on the lower face side thereof with a substantially quadrilateral shape in plan view for accommodating the quadrilateral core 4 to substantially half the height of the core.

The first core cover 2 includes a pair of linear portions where the corresponding portions of the recess 2*a* accommodates the opposite long sides of the core 4, which linear portions constitutes upper half winding portions 5*a* of linear winding portions 5. The upper half winding portions 5*a* are located on the inner side of outer wall portions 2*b* of the first core cover 2. Each of the upper half winding portions 5*a* is provided with a projection 13*a* that is integrally formed on the outer side of aside wall. The projection 13*a* is provided at the center part in the longitudinal direction so as to protrude in a short-length direction.

The first core cover includes peripheral walls that are formed on the opening side of the recess 2*a*, and are two thirds the full height of the first core cover. The peripheral walls each extend from one to the other of the positions corresponding to the respective centers of the opposite long sides of the core 4 partially accommodated in the core cover such that they are offset from each other at their linear portions along the opposite long sides of the core. Specifically, one of the offset peripheral walls is provided such that a portion of half the thickness of the peripheral wall is located at the inner side from the other peripheral wall, while the other peripheral wall is provided such that a portion of half the thickness thereof is located at the outer side accordingly. The inner one of the peripheral walls that are formed on the opening side of the recess and are two thirds the full height of the first core cover, constitutes an inserting protrusion 17 for engaging the second core cover 3.

The first core cover 2 also includes a mounting portion 15 on the upper face side thereof with an H shape in plan view. A top panel 16 (See FIG. 4.) is removably mounted on the mounting portion 15. The mounting portion 15 includes opposite parallel-side portions 15*b* that are integrally formed with the first core cover 2 to protrude from the portions of the first core cover 2 which are located over the opposite short sides of the core 4 partially accommodated in the recess 2*a*. The center bridge portion of the H-shaped mounting portion 15 also serves as a partition 15*a* for partitioning the opening of the first core cover 2 at the center thereof.

On the other hand, as shown in FIGS. 7A to 7E, the second core cover 3 is made of an insulating material such as synthetic resin and formed to have a substantially quadrilateral shape in plan view. The second core cover 3 includes a recess 3*a* formed on a central portion of the upper side to have a substantially quadrilateral shape in plan view for accommodating the quadrilateral core 4 to substantially half the height thereof. The lower surface of the second core cover 3 is provided with a pedestal portion 6 that is integrally formed therewith. The pedestal portion 6 protrudes more toward the component-mounting face than the winding portions 5, and extends out along the component-mounting face in a direction perpendicular to axis lines of the winding portions 5. The pedestal portion 6 has a substantially quadrate shape in sectional view.

The second core cover 3 includes a pair of linear portions where the corresponding portions of the recess 3*a* accommodates the opposite long sides of the core 4, which linear portions constitutes lower half winding portions 5*b* of the linear winding portions 5. The lower half winding portions 5*b* are located on the inner side of outer wall portions 3*b* of the second core cover 3. Each of the lower half winding portions 5*b* is provided with a projection 13*b* that is integrally formed on the outer side of a side wall. The projection 13*b* is provided at the center part in the longitudinal direction so as to protrude in the short-length direction. The second core cover further includes a partition 19 for partitioning a center opening defined therein. The partition 19 is disposed in parallel with the axis lines of the lower half winding portions 5*b*.

The lower face, at the tip of the protruding part of the pedestal portion 6 of the second core cover 3, is provided with seat faces 6*a* on which parts of the rectangular copper wires 8 drawn from the winding portions 5 toward the component-mounting face are provided as mounting terminals 12. The seat faces 6*a* form recesses 7 at which both ends of the rectangular copper wires 8 wound around the winding portions 5 are positioned, respectively, when the tip portions of the rectangular copper wires 8 are bent at the edge of the seat faces 6*a*. The upper face of the pedestal portion 6 is provided with grooves 14 that are formed therein and extend in the longitudinal direction. The tip of the rectangular copper wires 8, bent upward at the edge of the seat faces 6*a* at the tip, are inserted into the grooves 14.

The second core cover 3 includes peripheral walls that are formed on the opening side of the recess 3*a*, and are two thirds the full height of the second core cover. The peripheral walls each extend from one to the other of the positions corresponding to the respective centers of the opposite long sides of the core 4 partially accommodated in the core cover such that they are offset from each other at their linear portions along the opposite long sides of the core. Specifically, one of the offset peripheral walls is provided such that a portion of half the thickness of the peripheral wall is located at the inner side from the other peripheral wall, while the other peripheral wall is provided such that a portion of half the thickness thereof is located at the outer side accordingly. The inner one of the peripheral walls that is formed on the opening side of the recess and is two thirds the full height of the second core cover, constitutes an inserting protrusion 18 for engaging the first core cover 2.

Figure 8:
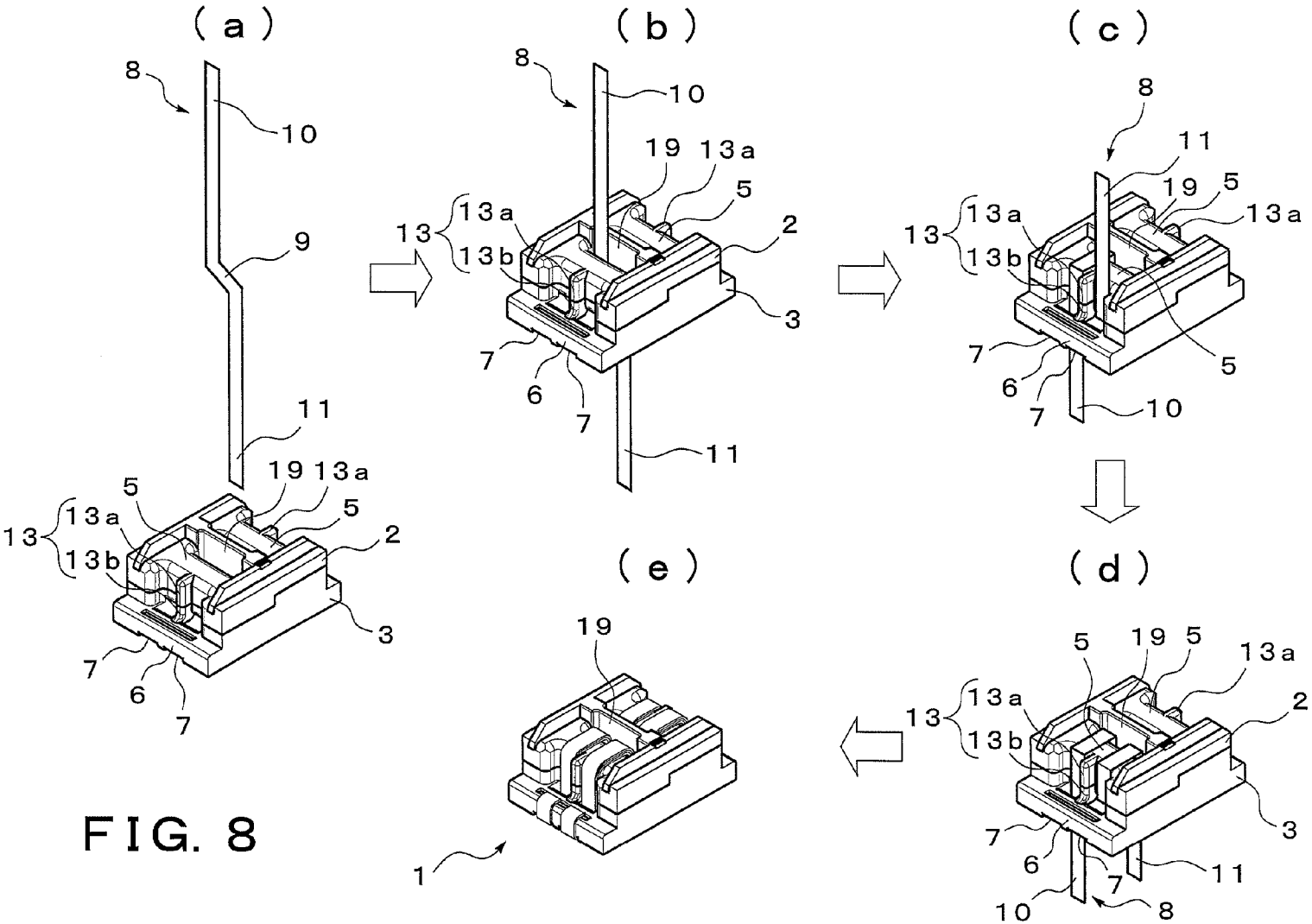
FIGS. 8(*a*) to 8(*e*) are perspective views illustrating a method that involves winding wires on winding portions of the first and second core covers and forming the pedestal.
Figure 9B:
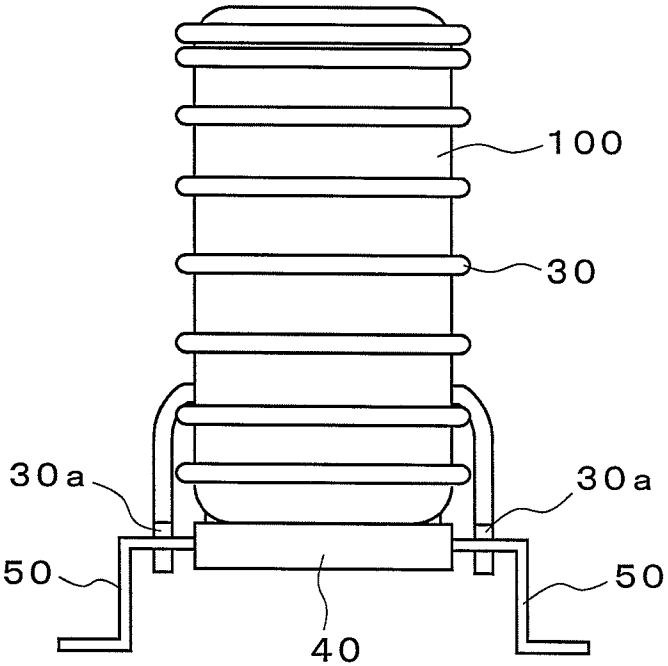
FIG. 9B (PRIOR ART)
FIG. 9B is a side view of the conventional common-mode choke coil.
Figure 9A:
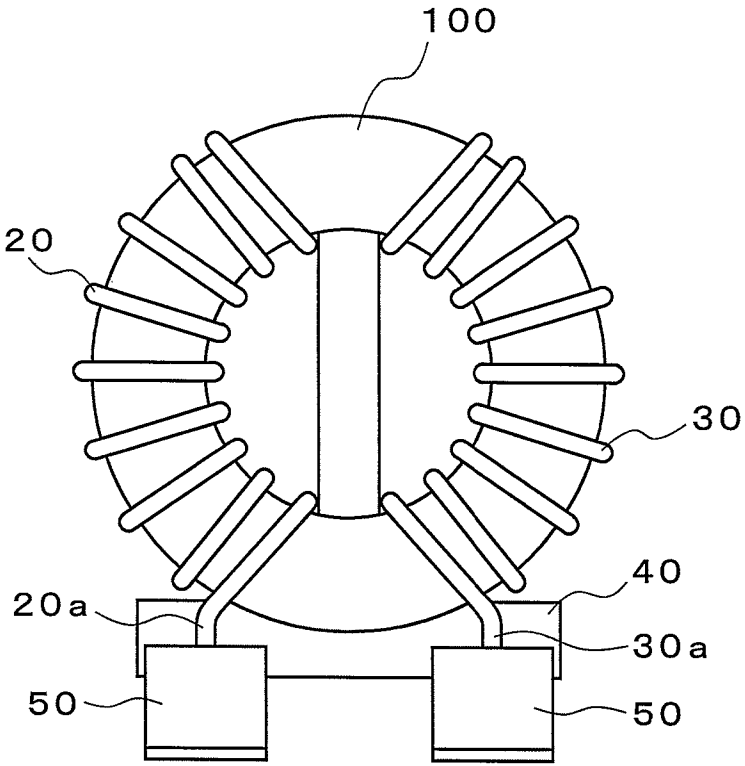
FIG. 9A (PRIOR ART)
FIG. 9A is a front view of a conventional common-mode choke coil.

As shown in FIG. 8(*a*), each of the rectangular copper wires 8 is bent in the in-plane direction at a position of the end of a portion of the wire extending from one end of the wire to a little less than two turns on the winding portion 5 to thereby form a first coil portion 10 on the side of that portion of the wire, and a second coil portion 11 on the other side of the wire with the bent portion 9 being located between the first and second coil portions. The first coil portion 10 and the second coil portion 11 are arranged in parallel rows separated from each other by a distance slightly greater than the width of the rectangular copper wires 8.

Figure 4:
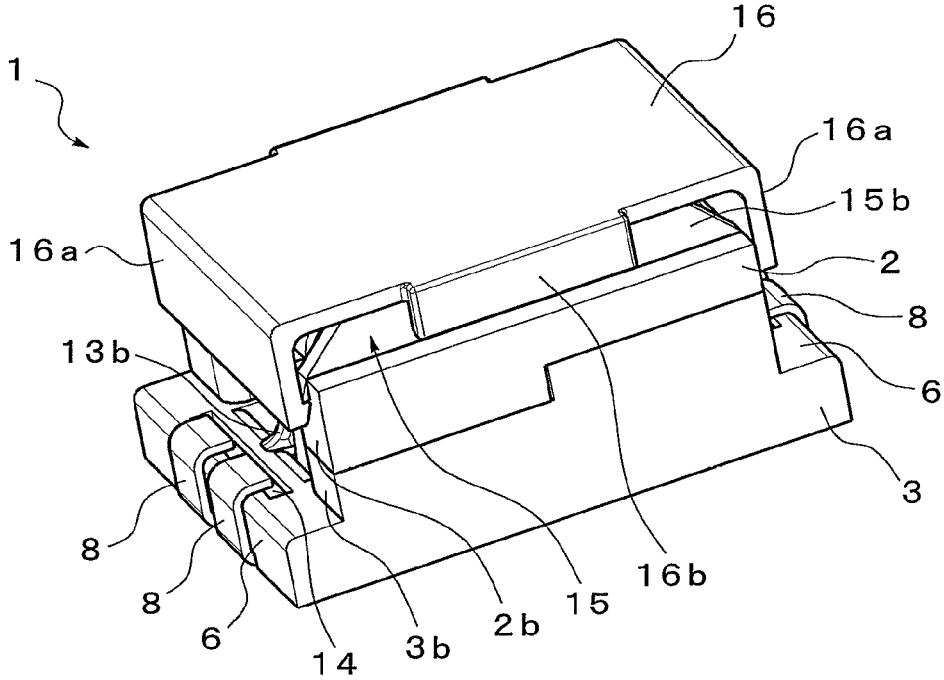
FIG. 4 is a perspective view of the common-mode choke coil in accordance with the present invention of FIG. 2 showing a state in which a top panel is mounted thereto.

As shown in FIG. 4, the top panel 16 that is removably mounted on the mounting portion 15 of the upper part of the first core cover 2 includes a flat portion having a rectangular shape in plan view. The flat portion is provided with hooking portions 16*a* that are provided at the ends in the longitudinal direction of the flat portion, respectively, and extend in the direction perpendicular to the flat portion. Each of the hooking portions 16*a* includes a hook for engaging the upper end part of the H-shaped mounting portion 15. The flat portion is also provided with abutting portions 16*b* at the respective center portions of both ends of the flat portion in the short-length direction for abutting the outer periphery of the mounting portion 15.

Figure 5:
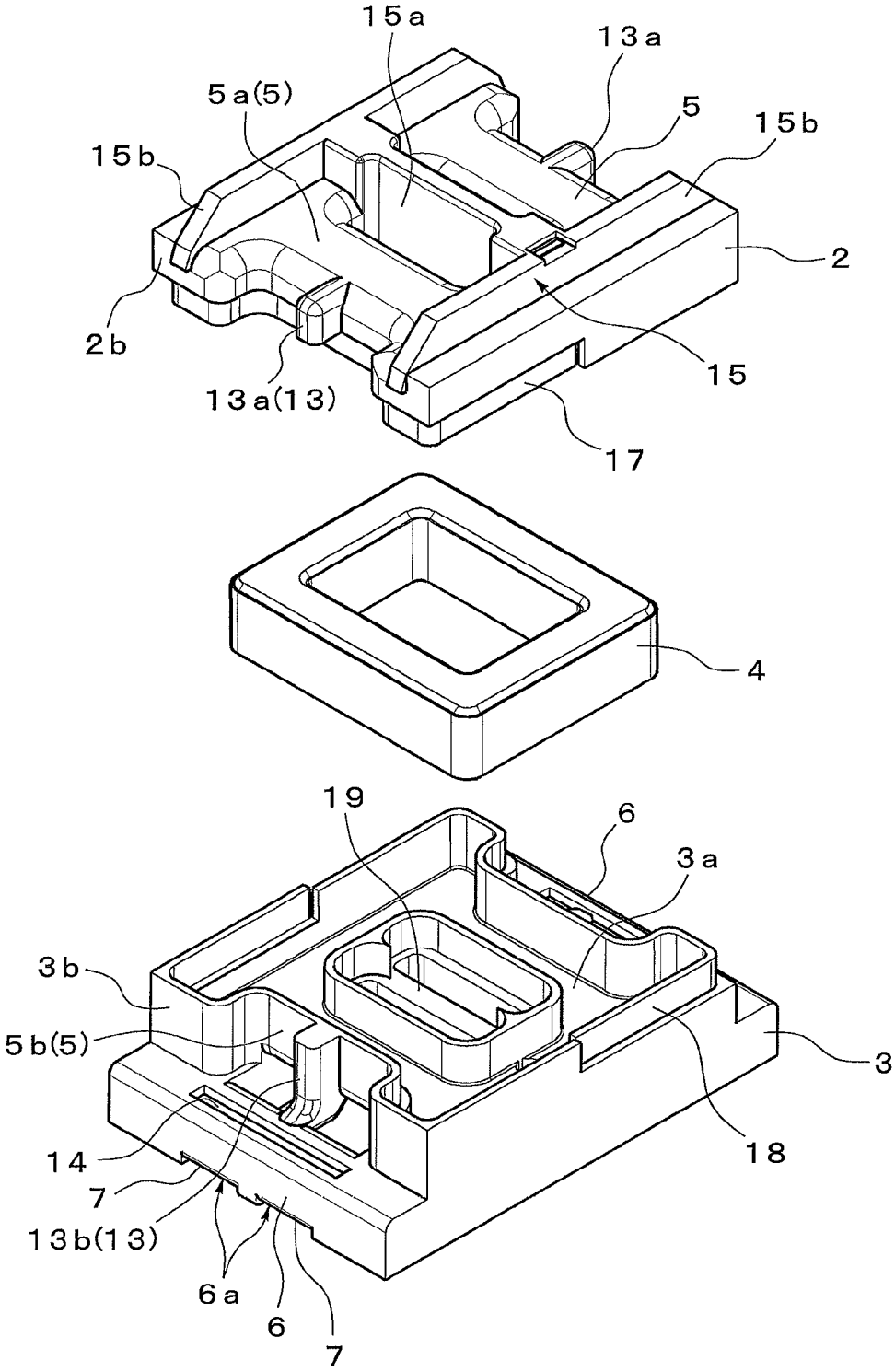
FIG. 5 is an exploded perspective view showing first and second core covers and a core.
Figure 6B:
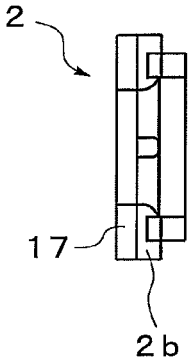
FIG. 6B is a left side view of the first core cover.
Figure 6A:
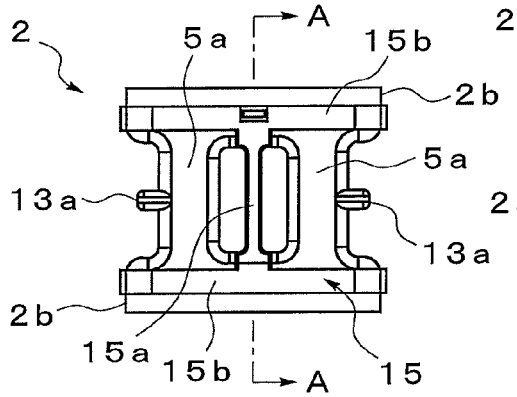
FIG. 6A is a plan view of the first core cover.
Figure 6D:
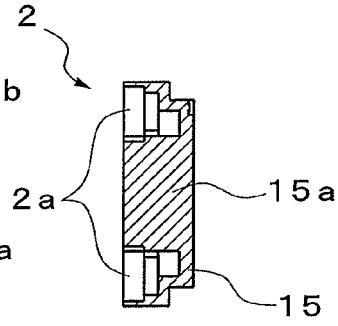
FIG. 6D is a cross-sectional view of the first core cover taken along line A-A in FIG. 6A.
Figure 6C:
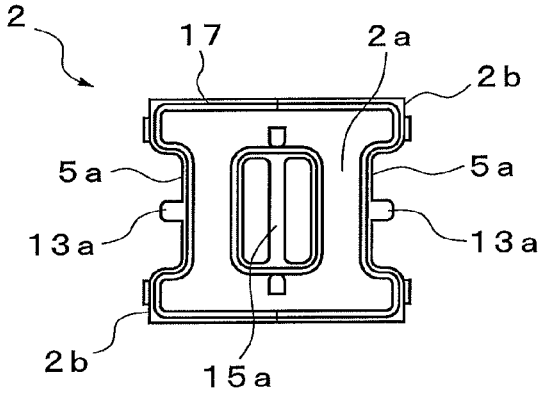
FIG. 6C is a bottom view of the first core cover.
Figure 7A:
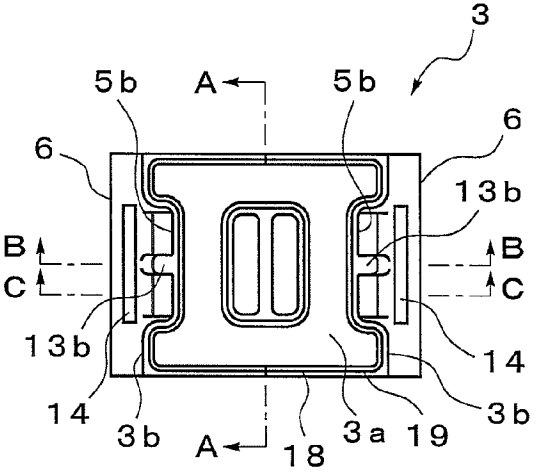
FIG. 7A is a plan view of the second core cover.
Figure 7B:
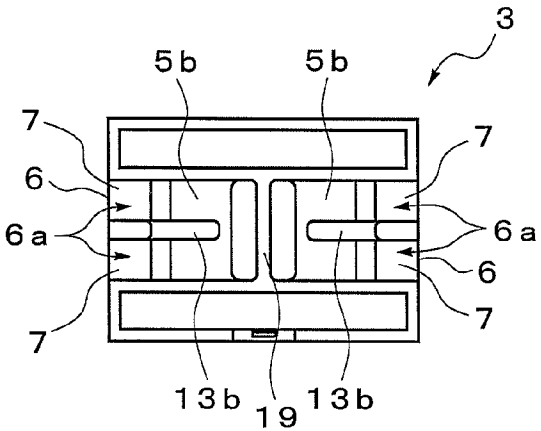
FIG. 7B is a bottom view of the second core cover.
Figure 7C:
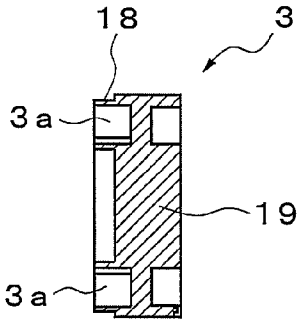
FIG. 7C is a cross-sectional view of the second core cover taken along line A-A in FIG. 7A.
Figure 7D:
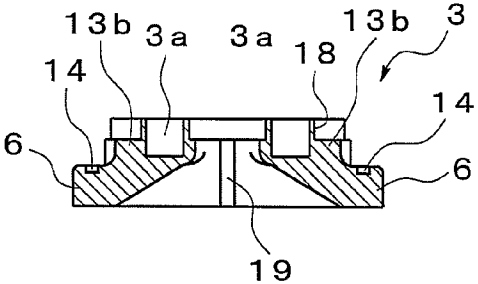
FIG. 7D is a cross-sectional view of the second core cover taken along line B-B in FIG. 7A.
Figure 7E:
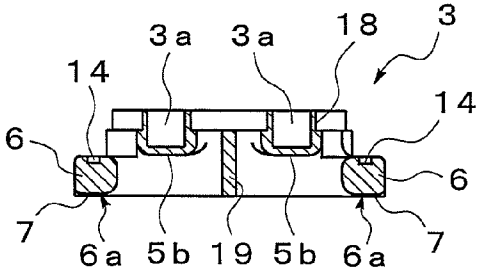
FIG. 7E is a cross-sectional view of the second core cover taken along line C-C in FIG. 7A.

When assembling the common-mode choke coil 1 configured as described above, the first and second core covers 2, 3 and the quadrilateral core 4 are prepared first, as shown in FIG. 5. Then, the quadrilateral core 4 is inserted into the recess 3*a* of the second core cover 3. The core 4 is accommodated in the recess 3*a* to substantially half the height of the core.

Next, the first core cover 2 is placed over the second core cover 3 such that the exposed half portion of the core 4 extending out from the recess 3*a* of the second core cover 3 is inserted into the recess 2*a* of the first core cover 2. This results in that the outer periphery of the core 4 is covered by insulating members, and the upper half winding portions 5*a* of the first core cover 2 and the lower half winding portions 5*b* of the second core cover 3, which surround the opposite sides of the quadrilateral core 4, are connected together to form the linear winding portions 5.

While the winding portions are formed, the inserting protrusion 17 formed in the peripheral wall of the recess 2*a* of the first core cover 2 and the inserting protrusion 18 formed in the peripheral wall of the recess 3*a* of the second core cover 3 are arranged opposite each other so that the inserting protrusion 17 of the first core cover 2 is inserted inside the recess 3*a* of the second core cover 3, and the inserting protrusion 18 of the second core cover 3 is inserted inside the recess 2*a* of the first core cover 2, whereby the first core cover 2 and the second core cover 3 are connected together into a unitary structure.

Next, the rectangular copper wires 8 are wound by an alpha-winding method on the respective winding portions 5 which surround the opposite sides of the core 4 placed therein. Each of the rectangular copper wires 8 is wound to form the first coil portion 10 and the second coil portion 11 arranged in parallel rows separated from each other by a distance slightly greater than the width of the rectangular copper wire 8 with a projection 13 of the winding portion 5 being located between the first and second coil portions. One and the other ends of each rectangular copper wire 8 are drawn out toward the lower side of the second core cover 3, respectively.

A method of winding the rectangular copper wire 8 on the winding portion 5 is described in detail below with reference to FIGS. 8(*a*) to 8(*e*).

First, as shown in FIG. 8(*a*), in order to wind the rectangular copper wire 8 on one of the winding portions 5 disposed opposite to each other, the end of the rectangular copper wire 8 on the side of the second coil portion 11 is inserted in the inner side of the winding portion 5 from the upper side of the first core cover 2.

Next, as shown in FIG. 8(*b*), the bent portion 9 of the rectangular copper wire 8 is positioned at the center of the winding portion 5. Then, as shown in FIG. 8(*c*), the part of the rectangular copper wire 8 on the side of the first coil portion 10 is wound on the upper side of the winding portion 5, and the end of the part is inserted through between the winding portion 5 and the pedestal portion 6 and drawn out downward. On the other hand, the part of the rectangular copper wire 8 on the side of the second coil portion is wound on the lower side of the winding portion 5, and the end of the part is inserted through between the winding portion 5 and the pedestal portion 6 and drawn out upward.

As these parts of the rectangular copper wire 8 are wound so as to form the first coil portion 10 and the second coil portion 11 arranged in parallel rows separated from each other by the distance slightly greater than the width of the rectangular copper wire 8, the first coil portion 10 and the second coil portion 11 are respectively wound on the winding portion 5 with the projection 13 formed on the outer side of the winding portion 5 being located between them.

Then, as shown in FIG. 8(*d*), the part of the rectangular copper wire 8 on the side of the first coil portion 10 is wound on the winding portion 5, and the end of the part is drawn out downward from the second core cover 3, whereas the part of the rectangular copper wire 8 on the side of the second coil portion 11 is wound on the winding portion 5, and the end of the part is drawn out downward from the second core cover 3.

Next, the end part of the wire on the side of the first coil portion 10 is drawn up toward the lower face side of the pedestal portion 6 and is positioned at one of the recesses 7, which constitutes the seat face 6*a*. Then, the rectangular copper wire 8 is bent at the inner edge of the recess 7 to abut the bottom portion of the recess 7. Then, the rectangular copper wire 8, which abuts the bottom portion of the recess 7, is bent at the outer edge of the recess 7, and the end part of the wire is fed to the upper side of the pedestal portion 6.

Figure 2:
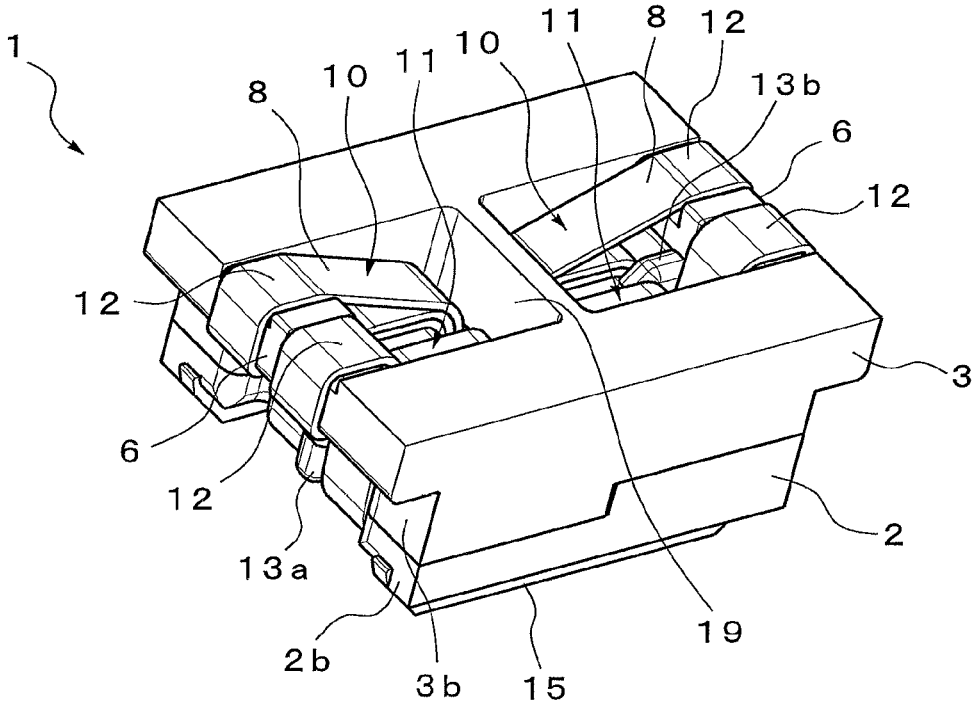
FIG. 2 is a perspective view showing the lower face side of the common-mode choke coil of FIG. 1.
Figure 3:
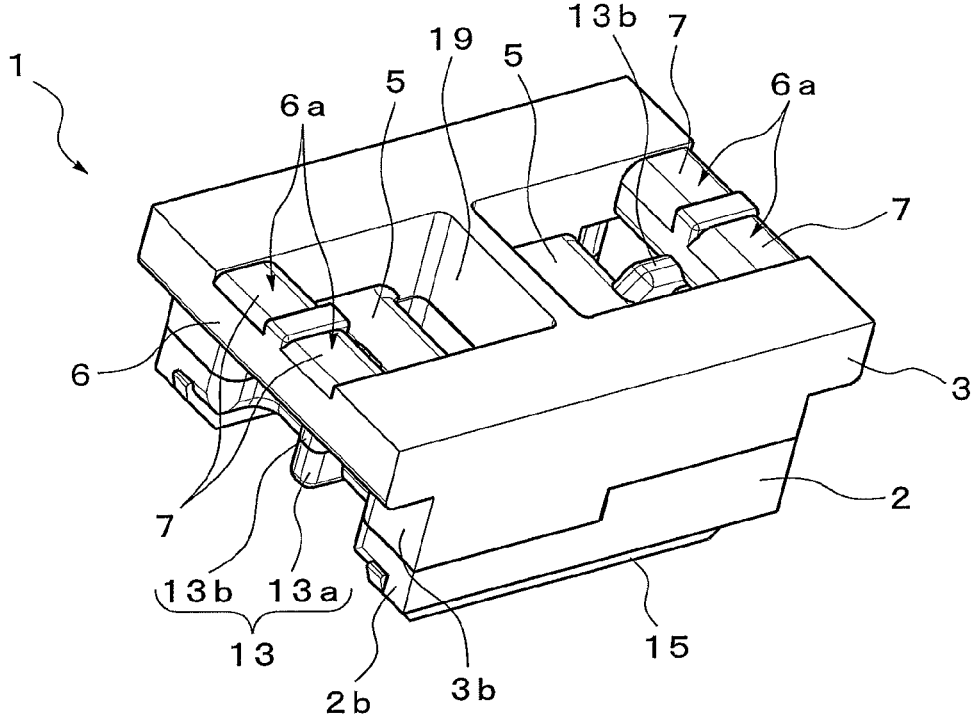
FIG. 3 is a perspective view of the common-mode choke coil of FIG. 2 showing a state in which rectangular copper wires are eliminated.

Next, the end part of the rectangular copper wire 8 fed to the upper side of the pedestal portion 6 is bent at the outer edge of the upper face of the pedestal portion 6 so as to abut the upper face. Thereby, as shown in FIG. 2, the mounting terminals 12 are formed in the recesses 7, which constitute the seat faces 6*a* of the pedestal portion 6, and springback of the rectangular copper wire 8 can be suppressed. When the end part of the rectangular copper wire 8 is inserted into the groove 14 formed at the upper face of the pedestal portion 6, the springback of the wire is further suppressed.

On the other hand, the end part of the wire on the side of the second coil portion 11 is also drawn up toward the lower face side of the pedestal portion 6 and is positioned at one of the recesses 7, which constitutes the seat face 6*a*, in a similar manner to the end part of the wire on the side of first coil portion 10. Next, the rectangular copper wire 8 is bent at the inner edge of the recess 7 to abut the bottom portion of the recess 7. Then, the rectangular copper wire 8, which abuts the bottom portion of the recess 7, is bent at the outer edge of the recess 7, and the end part of the wire is fed to the upper side of the pedestal portion 6.

Next, the rectangular copper wire 8 fed to the upper side of the pedestal portion 6 is bent at the outer edge of the upper face of the pedestal portion 6 so that the end part of the wire abuts the upper face. Thereby, in a similar manner to the end part of the wire on the side of the first coil portion 10, the mounting terminals 12 are formed in the recesses 7, which constitute the seat faces 6*a* of the pedestal portion 6 as shown in FIG. 2, and springback of the rectangular copper wire 8 is suppressed. When the end part of the rectangular copper wire 8 is inserted into the groove 14 formed at the upper face of the pedestal portion 6, the springback of the wire is further suppressed.

Also, in regard to the other one of the winding portions 5 disposed opposite to each other along the longitudinal sides of the core 4, the first coil portion 10 and the second coil portion 11 of the rectangular copper wire 8 are respectively wound on the winding portion 5 with the projection 13 being located between the first and second coil portions using the above described winding method. That is, after the respective end parts of the rectangular copper wire 8 are drawn out toward the lower side of the second core cover 3, the parts are bent at the edges of the respective recesses 7, which constitute the seat faces 6*a*, and they are further bent at the outer edges of the upper face of the pedestal portion 6 so as to form the mounting terminals 12 as shown in FIG. 2.

Then, as shown in FIG. 4, the top panel 16 is mounted to the mounting portion 15 provided on the upper side of the first core cover 2 by having the hooks of the hooking portions 16*a* of the top panel 16 engage the respective upper end parts of the opposite parallel-side portions 15*b* of the mounting portion 15 and having the abutting portions 16*b* abut the opposite parallel-side portions 15*b*.

Next, the flat portion of the top panel 16 is vacuum-sucked with a vacuum device, and then the common-mode choke coil is transferred to the component-mounting face of the circuit board. Upon being transferred, the common-mode choke coil is mounted on the component mounting face with the four mounting terminals 12, which are formed at the recesses 7 constituting the seat faces. 6*a* of the pedestal portion 6, being placed at predetermined sites on the component-mounting face so as to lie in the same plane. Then, the common-mode choke coil is subjected to soldering on the component-mounting face to be surface-mounted thereon.

In the common-mode choke coil 1 configured as described above, the pedestal portion 6 protrudes more toward the component-mounting face than the winding portions 5 of the first and second core covers 2, 3 surrounding the opposite sides of the core 4, and extends out in the direction perpendicular to axis lines of the winding portions 5, and the lower face at the tip of the protruding part of the pedestal portion 6 is provided with the seat faces 6*a* on which the rectangular copper wires 8 drawn from the winding portions are provided as the mounting terminals 12. Thus, the height uniformity among a plurality of the mounting terminals 12 of the coil is improved, thereby allowing the mounting terminals 12 to be easily located on the same plane and ensuring that the mounting terminals 12 are disposed at the respective mounting position on the component-mounting face. This increases the reliability of surface mounting and improves the quality thereof.

Moreover, the lower surface of the second core cover 3 is provided with the pedestal portion 6 having the seat faces 6*a* formed thereon, and is integrally formed therewith, by which a reduction in height can be achieved. The feature can also reduce the number of components and assembling process steps, which thereby can reduce manufacturing costs and contribute to the reduction in size of the product.

In addition, the seat faces 6*a* form the recesses 7 at which one and the other ends of the rectangular copper wires 8 are positioned, respectively. Thus, when the rectangular copper wires 8 are manually bent in the manufacturing process, the rectangular copper wires 8 can be bent at the edge of the seat faces 6*a* without displacements of the wires, resulting in increased work efficiency in the assembling process.

Furthermore, the top panel 16 having the flat portion is removably mounted on the top portion of the first core cover 2. Thus, while providing protection for the rectangular copper wires 8 wound in the winding portions 5 and the like, the flat portion of the top panel 16 allows the common-mode choke coil to be securely vacuum-sucked and held, thereby enabling efficient handling and transfer of the common-mode choke coil 1.

It should be noted that the present invention is applicable to a common-mode choke coil adapted for high current applications and surface-mounting.

What is claimed is:

1. A common mode choke coil comprising:

a quadrilateral core;

first and second core covers disposed opposite to each other on the upper and lower surfaces of the core so as to cover the outer periphery of the core; and rectangular copper wires extending from the outer peripheries of the first and second core covers and wound on the opposite side portions of the core;

wherein the second core cover is disposed on a component-mounting face of a circuit board;

wherein the first and second core covers include a pair of linear portions surrounding the corresponding opposite sides of the core which linear portions constitute winding portions of the rectangular copper wires, and the lower surface of the second core cover is provided with a pedestal portion that is integrally formed therewith, wherein the pedestal portion protrudes more toward the component-mounting face than the winding portions, and extends out along the component-mounting face in a direction perpendicular to axis lines of the winding portions; and wherein the lower face at the tip of the protruding part of the pedestal portion is provided with seat faces on which parts of the rectangular copper wires drawn from the winding portions toward the component-mounting face are provided as mounting terminals, and tip portions of the rectangular copper wires are bent upward from the seat faces at the edge of the tip of the protruding part of the pedestal portion.

2. The common mode choke coil according to claim 1, wherein the seat faces form recesses at which one and the other ends of the rectangular copper wires are positioned, respectively.

3. The common mode choke coil according to claim 1, further comprising a top panel having a flat portion, the top panel being removably mounted on the top portion of the first core cover.

* * * * *